United States Patent [19]

Pankratz et al.

[11] 4,437,498

[45] Mar. 20, 1984

[54] CARTON FILLING APPARATUS

[75] Inventors: Lawrence A. Pankratz, St. Paul; Donald G. Corniea, Inver Grove Heights, both of Minn.

[73] Assignee: Liquipak International, Inc., St. Paul, Minn.

[21] Appl. No.: 319,691

[22] Filed: Nov. 9, 1981

[51] Int. Cl.[3] ..... B67C 3/02

[52] U.S. Cl. ..... 141/89; 141/258; 141/302; 222/380

[58] Field of Search ..... 141/89–91, 141/145, 146, 237, 238, 245, 258, 260, 261, 37–67, 285–310; 53/565; 222/333, 334, 380

[56] References Cited

U.S. PATENT DOCUMENTS

| | | | |
|---|---|---|---|
| 2,850,051 | 9/1958 | Rasmusson | 141/242 X |
| 2,850,990 | 9/1958 | Rasmusson | 222/380 X |
| 3,074,597 | 1/1963 | Felts | 222/380 X |
| 3,088,380 | 5/1963 | Vergobbi . | |
| 3,153,374 | 10/1964 | Borkmann et al. . | |
| 3,405,505 | 10/1968 | Mistarz . | |
| 3,669,160 | 6/1972 | Mistarz . | |
| 3,841,363 | 10/1974 | Stigler | 141/146 X |
| 3,850,345 | 11/1974 | Merritt | 222/380 X |

FOREIGN PATENT DOCUMENTS

| | | |
|---|---|---|
| 709454 | 5/1954 | United Kingdom . |
| 1001155 | 8/1965 | United Kingdom . |
| 1001156 | 8/1965 | United Kingdom . |

*Primary Examiner*—Houston S. Bell, Jr.

*Attorney, Agent, or Firm*—Kinney, Lange, Braddock, Westman and Fairbairn

[57] ABSTRACT

A carton filling apparatus supplies precise quantities of a liquid food product, such as milk or fruit juice, into an open top container such as a thermoplastic coated paperboard carton. The carton filling apparatus includes a fill tank or reservoir which holds the liquid product and a vertical passage which has an inlet at its upper end communicating with the fill tank and an outlet at its lower end from which liquid is dispensed into the carton. A pumping chamber is connected to the vertical passage to draw a controlled quantity of liquid from the fill tank and then pump that liquid through the vertical passage to the outlet. A vertically oriented linear movable valve rod or stem extends along a vertical axis downward through the fill tank and the vertical passage. The valve stem has a first portion which permits liquid flow from the fill tank to the pumping chamber when the valve member is in a first position along the vertical axis and which blocks liquid flow to the pumping chamber when the valve stem is in a second position along the vertical axis. The valve stem also has a second portion which blocks liquid flow from the pumping chamber to the outlet when the valve stem is in the first position and which permits liquid flow from the pumping chamber to the outlet when the valve stem is in the second position. A valve actuator moves the valve stem along the vertical axis between the first and second positions. Operation of the valve actuator is coordinated with operation of the drive for the pumping chamber.

23 Claims, 10 Drawing Figures

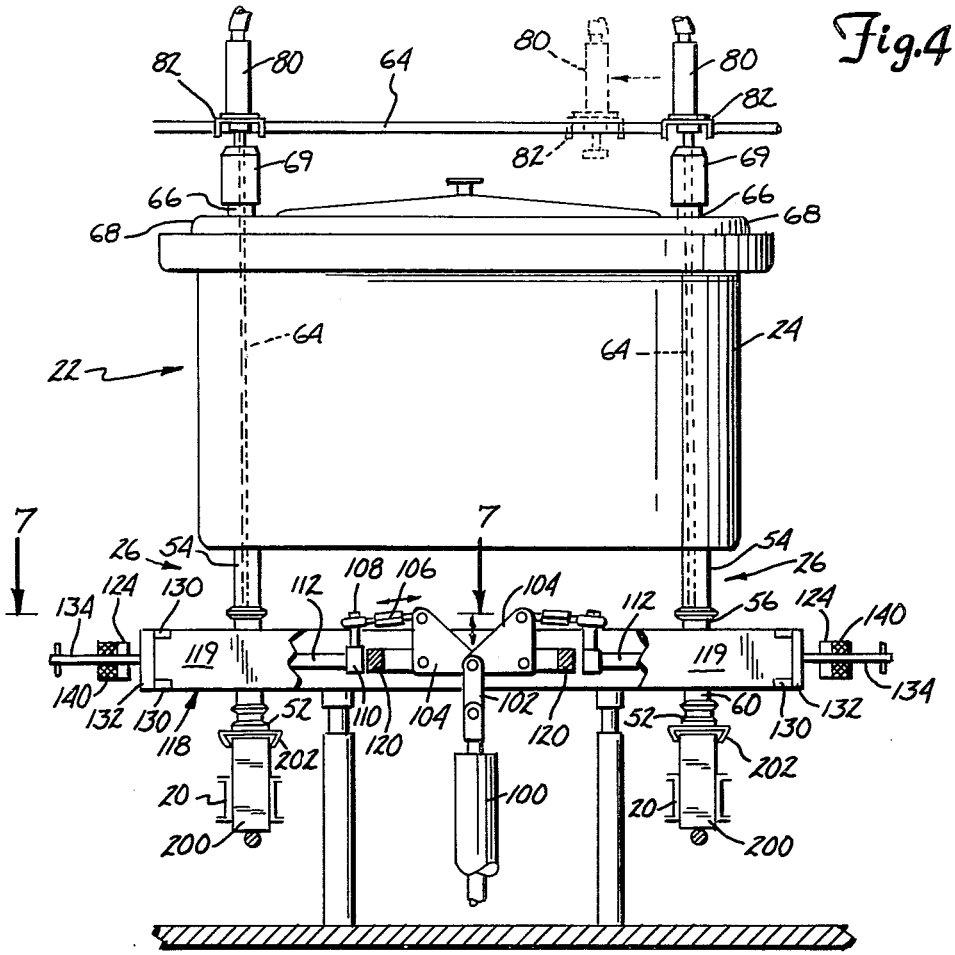
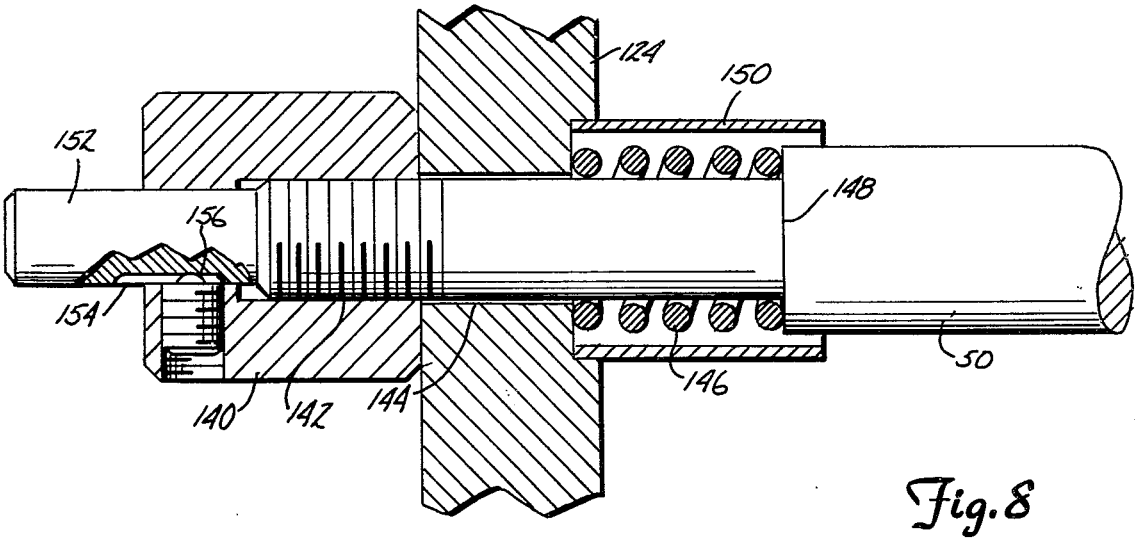
Fig.8

CARTON FILLING APPARATUS

BACKGROUND OF THE INVENTION

1. Field of the Invention

The present invention relates to apparatus for dispensing measured quantities of a liquid such as milk or fruit juice into an open top container.

2. Description of the Prior Art

One common type of container in which liquid food products such as milk and fruit juices are sold is a gable top carton made of paperboard or the like which has heat sealable top and bottom closure panels. In general, this type of carton is made of a high grade paperboard stock which is coated on both sides with a thermoplastic material such as polyethylene. The polyethylene coating on the paperboard is used for moisture-proofing, and is also a heat and pressure sensitive adhesive used to seal the top and bottom closure panels of the carton to make it liquid tight.

Automatic machines have been developed which erect flat, collapsed cartons of this type, form and seal the bottom ends of the carton, fill the cartons with the liquid product, and form and seal the top ends of the cartons. These machines generally include a rotatable mandrel assembly which is driven in a step-by-step indexing motion. The flat, collapsed cartons are withdrawn from a magazine, erected into an open-end tubular form and loaded onto each mandrel. As the mandrel assembly is rotated, the carton blank on the mandrel is sequentially advanced to work stations at which the bottom closure panels of the blank are broken, the bottom is heated, and the bottom is closed and sealed. Finally, each carton blank, with its bottom end sealed and its top end open, is withdrawn from its mandrel and deposited on a conveyor line. The cartons on the conveyor line are advanced through a top breaker unit at which the top panels are broken, a filling area at which the cartons are filled with the desired quantity of liquid, a defoamer area at which foam generated during the filling of the liquid is removed, a top heater area at which the polyethylene coating on the carton is heated, a top folding area at which the top panels are folded, and a top sealing area at which the tops of the cartons are sealed.

Examples of machines of this general type are shown in U.S. Pat. Nos. 3,088,380; 3,153,374; 3,405,505; and 3,669,160; and in British Pat. Nos. 709,454; 1,001,595; and 1,001,596.

One important portion of this type of machine is the carton filling apparatus, which must provide precisely measured quantities of the liquid into the containers at a high rate consistent with the cycle rate of the machine.

The carton filling apparatus used in prior art machines typically includes a fill tank reservoir for holding the liquid product, a vertically oriented piston and cylinder, a fluid passage from the tank to the cylinder, and a passage from the cylinder to a dispensing outlet. A valve arrangement controls flow from the tank to the pumping chamber formed by the piston and cylinder and flow from the pumping chamber to the outlet.

In one type of prior art system, a rotary valve arrangement is used. In one position, the rotary valve connects the tank to the pumping chamber so that the pumping chamber can draw liquid from the tank. In the other position, the rotary valve connects the pumping chamber with the outlet so that the movement of the piston discharges the liquid within the pumping chamber into the carton.

Another commonly used valve arrangement includes a pair of spring loaded check valves. One check valve is arranged between the tank and the pumping chamber, and the other check valve is located at the outlet. One disadvantage of spring loaded check valves is that pressure of the liquid product is required to open the check valve at the outlet, and the liquid then has to be squeezed through that orifice. In the process of opening the check valve at the outlet, the liquid velocity created generates foam. This foam subsequently must be removed so that proper sealing of the top ends of the cartons can be achieved.

Because the product being dispensed is a food product, rather stringent cleaning procedures are necessary for health reasons. The cleaning procedures normally are of two types: cleaning in place and disassembly for handwashing. It is general practice in the dairy industry, for example, to clean the fill apparatus in place on a daily basis. This involves cleaning the fill apparatus without disassembling it by running a cleaning solution through the fill apparatus. In addition, it is common practice to systematically disassemble the fill apparatus on some sort of routine. Since most machines have multiple outlets for filling cartons in stages, it is common to disassemble and handwash the various individual fill assemblies on a rotating basis.

One continuing problem with prior art fill apparatus has been the ability to thoroughly clean the apparatus "in place". O-rings, which are commonly used as part of the valve mechanisms of prior art fill apparatus are not fully cleanable in place because of the possibility of product or contaminants getting behind the O-rings and making it difficult to clean behind those areas. In addition, the various components of spring loaded check valves, including retainers of the valves and valve seat all provide ideal hiding places for bacteria to grow.

Still another disadvantage of the prior art fill apparatus has been that the connection between the bottom of the fill tank and the outlet has normally been rather long (18 inches or more). Not only does this increase cost, since these connections normally are of expensive stainless steel, but it also increases the area at which bacteria can grow and which must be cleaned.

The prior art fill apparatus has typically been rather complex to disassemble, hand-clean and then reassemble. As a result, disassembly and handcleaning of the prior art fill apparatus has been time-consuming, and thus the frequency of disassembly and handwashing has typically been minimized.

There is a continuing need for improved fill apparatus for use in machines which fill cartons with liquid food products such as milk and fruit juices which is easily cleaned in place, has a minimum number of areas which bacteria can grow, and which has a minimum number of parts which can be easily disassembled and handcleaned.

SUMMARY OF THE INVENTION

The present invention is a container filling apparatus for filling an open top container with a predetermined quantity of a liquid food product. The apparatus includes fill tank means for holding the liquid; a vertical passage through which the liquid flows from the fill tank into the container; pumping chamber means; a vertically oriented, linearally movable valve member; drive means for driving the pumping chamber; and valve actuator means for moving the valve member along a vertical axis.

The vertical passage has an inlet at its upper end which communicates with the fill tank means, and has an outlet at its lower end from which the liquid is dispensed into the container. The pumping chamber is connected to the vertical passage and is driven by the drive mean to draw liquid from the fill tank through the vertical passage into the pumping chamber and to pump the liquid from the pumping chamber through the vertical passage to the outlet. Control of liquid flow through the vertical passage is provided by the vertical valve member, which is controlled by the valve actuator. The vertical valve member extends along a vertical axis downward through the fill tank and the vertical passage. The valve member has a first portion which permits liquid flow from the fill tank through the vertical passage to the pumping chamber when the valve member is in a first position along the vertical axis. The first portion of the vertical valve member blocks liquid flow from the fill tank through the vertical passage to the pumping chamber when the valve member is in a second position along the vertical axis. The valve member also has a second portion which blocks liquid flow from the pumping chamber through the vertical passage to the outlet when the valve member is in the first position and which permits liquid flow from the pumping chamber through the vertical passage to the outlet when the valve member is in the second position.

The valve actuator means moves the valve member in a manner which is coordinated with the drive means so that the valve member is in its first position when the drive means causes the pumping chamber to draw liquid from the fill tank means into the pumping chamber. The valve actuator causes the valve member to be in its second position when the drive means causes the pumping chamber means to pump liquid from the pumping chamber means to the outlet.

In one preferred embodiment of the present invention, the pumping chamber means is a piston and cylinder which is connected to the vertical passage and is oriented along a horizontal axis. The valve member is preferably a valve stem which extends downwardly from a top end above the fill tank through the fill tank and the vertical passage. The valve actuator means is connected to the upper end of the valve stem.

BRIEF DESCRIPTION OF THE DRAWINGS

FIG. 4 is an end view of the fill apparatus of the present invention.

FIG. 8 is a sectional view along section 8—8 of FIG. 5 showing the apparatus for adjusting displacement of the pumping chamber of the fill apparatus of the present invention.

DETAILED DESCRIPTION OF THE PREFERRED EMBODIMENTS

Figure 1:
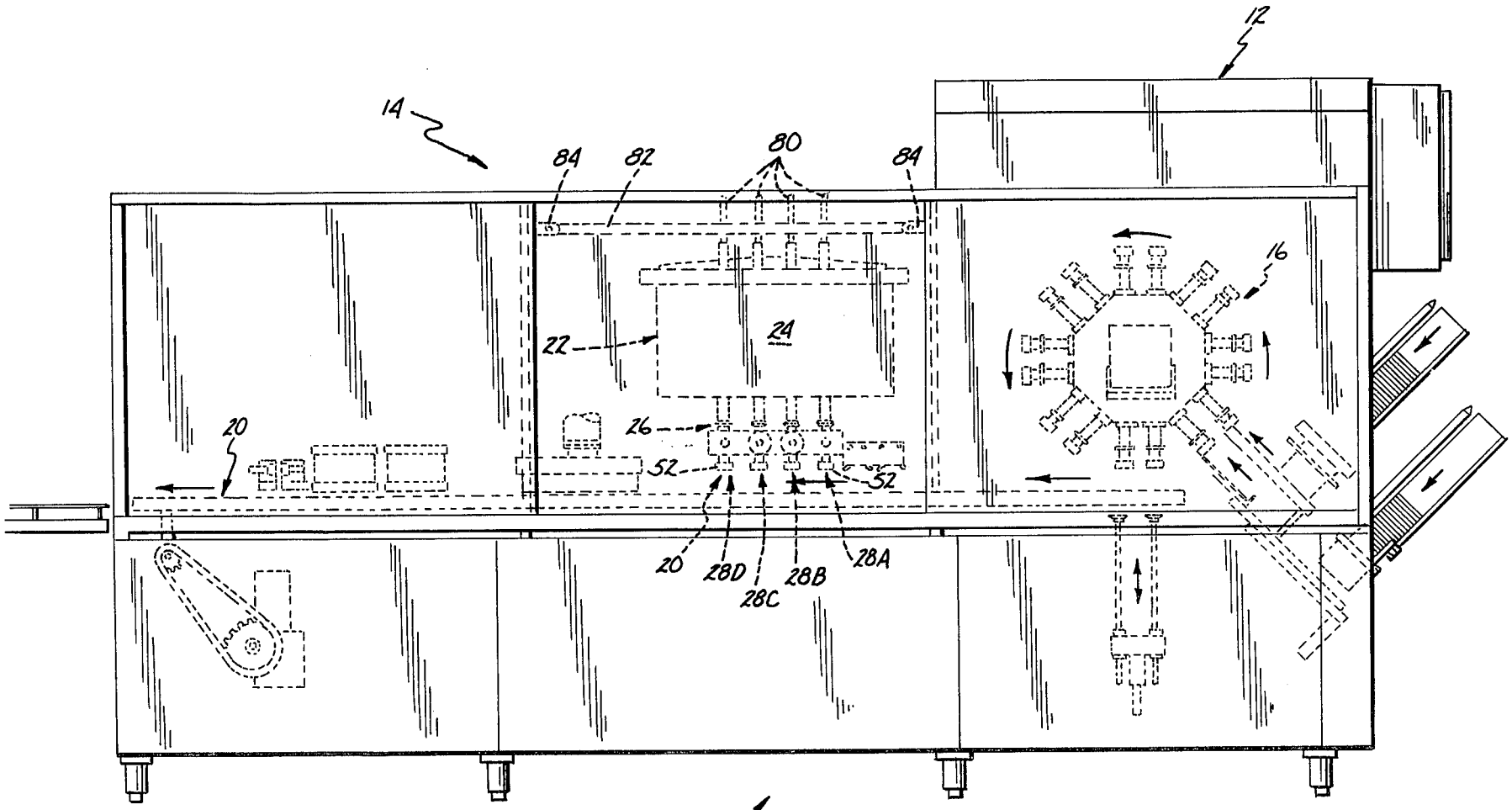
FIG. 1 is a side elevation of a machine which erects flat collapsed cartons and fills and seals the erected cartons, and which includes the fill apparatus of the present invention.
Figure 2:
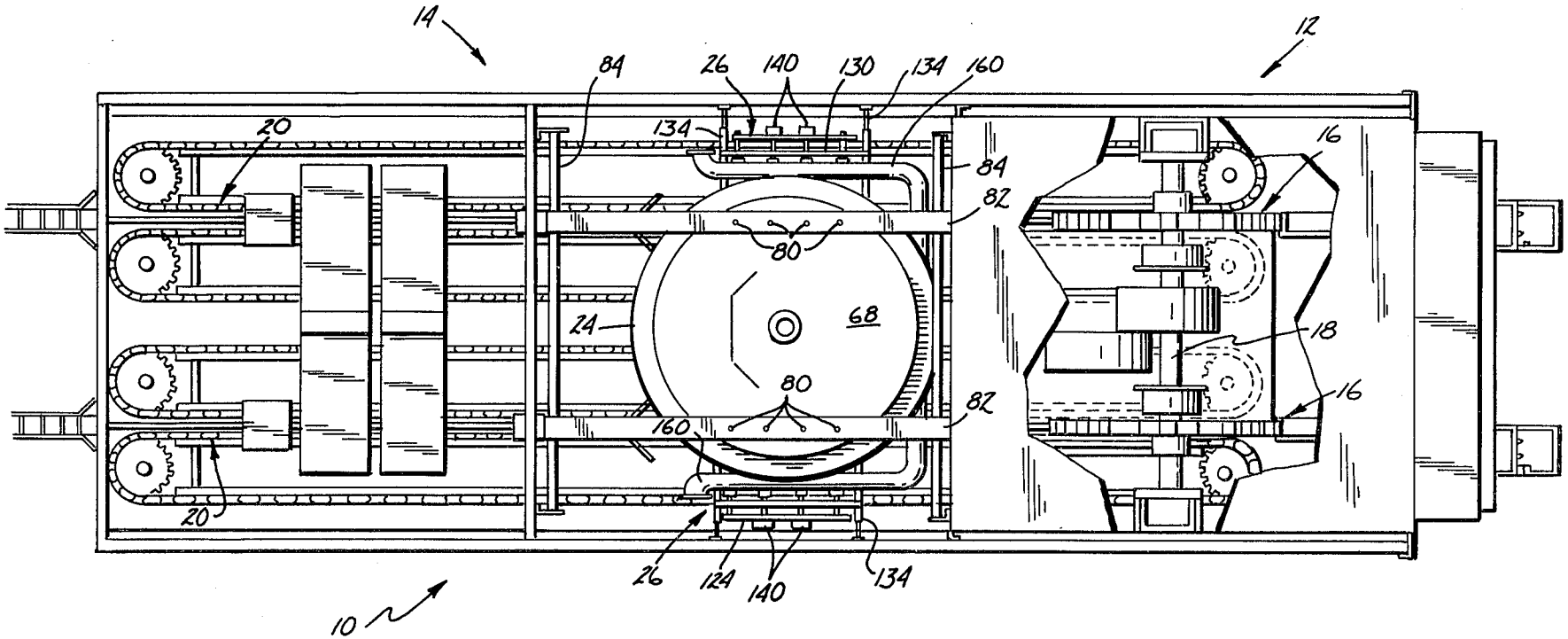
FIG. 2 is a top plan view of the machin of FIG. 1.
Figure 3:
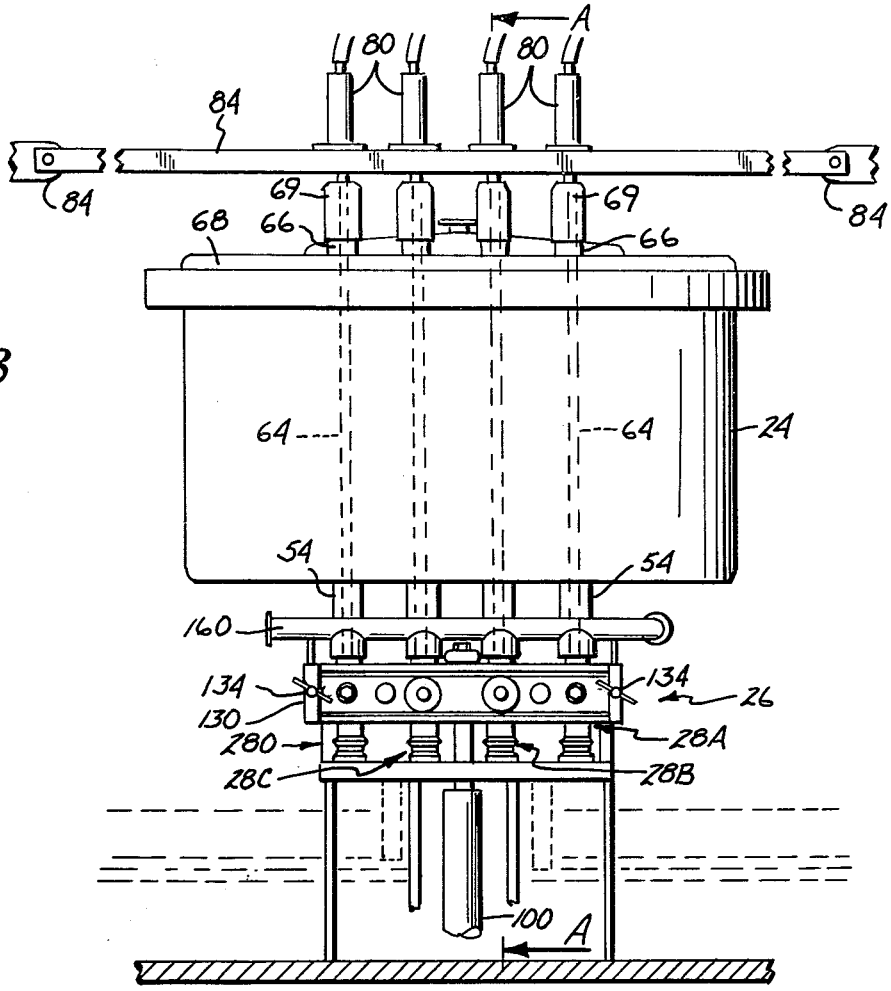
FIG. 3 is a side elevation of the fill apparatus of the present invention.

In FIGS. 1 and 2, a carton erecting, filling and sealing machine 10 is shown which embodies the present invention. Machine 10 is a double indexing/dual conveyor line machine which provides a four fold increase in production rate with the same cycle rate compared to a conventional single line machine.

As illustrated in FIGS. 1 and 2, machine 10 includes a carton erecting section 12 and a filling and sealing section 14. Carton erecting section 12 includes a pair of vertically oriented mandrel assemblies 16 which are rotated in stepwise fashion about a common horizontal axis of rotation defined by mandrel drive shaft 18. Cartons formed on mandrel assemblies 16 are deposited into a pair of parallel horizontal conveyor tracks 20. The cartons deposited in conveyor tracks 20 have sealed bottom ends and open top ends. As the cartons are advanced along conveyor tracks 20 they are brought sequentially into alignment with a series of work stations where they are filled and top sealed. The cartons are eventually driven off the end of conveyor lines 20 onto conveyor assembly 21.

Machine 10 shown in FIGS. 1 and 2 is described in further detail in a co-pending patent application Ser. No. 06/319,801, entitled "Multiple Mandrel Carton Erecting, Filling And Sealing Machine with Two-Stage Loading", filed on even date with this application and assigned to the same assignee. The present invention relates to filling apparatus 22, which fills the cartons with liquid, and only this portion of machine 10 will be described in detail. Further description of other portions of machine 10 can be found in the above-mentioned co-pending application.

Filling apparatus 22 of the present invention includes fill tank 24 and two banks of dispensers 26, one for each conveyor 20. Each bank 26 of dispensers includes four individual dispensers 28A–28D from which milk or other liquid is dispensed. The machine 10 shown in FIGS. 1 and 2 is a double indexing conveyor system in which a pair of cartons are formed simultaneously and are then indexed from workstation-to-workstation along conveyor 20. As a result, dispensing outlets 28A and 28B fill the pair of cartons approximately half full. During the next cycle of machine 10, the carton under dispenser 28A is indexed to a position under dispenser 28C, and the carton under dispenser 28B is indexed to a position below dispenser 28D. Dispensers 28C and 28D dispense the remaining quantity of liquid required to fill the two cartons.

Figures 5, 10:
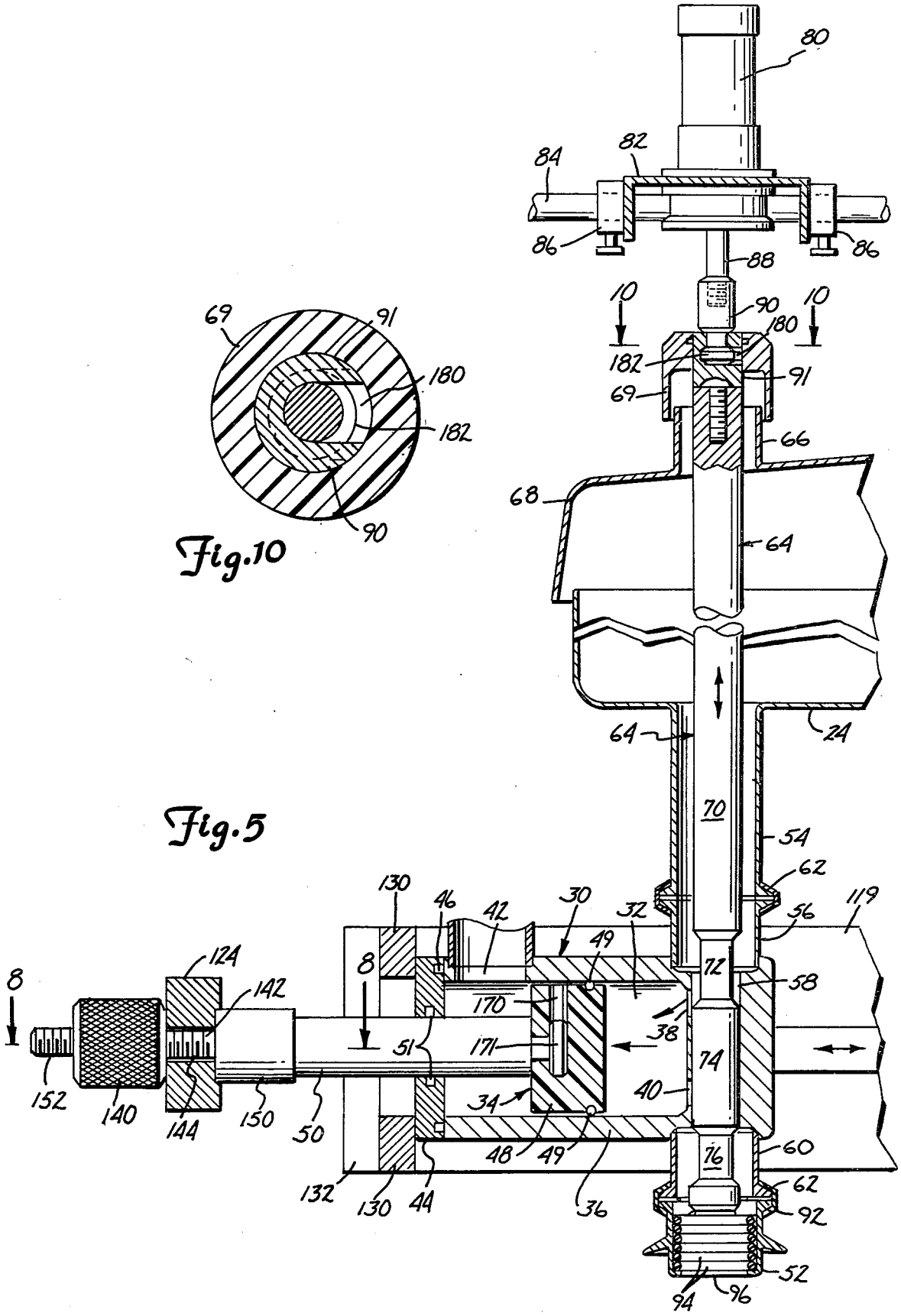
FIGS. 5 and 6 are sectional views along section A—A of FIG. 3 illustrating operation of the fill apparatus of the present invention.
FIG. 10 is a sectional view along section 10—10 of FIG. 5 which illustrates the manner in which the valve actuator is connected to the valve stem.
Figures 6, 9:
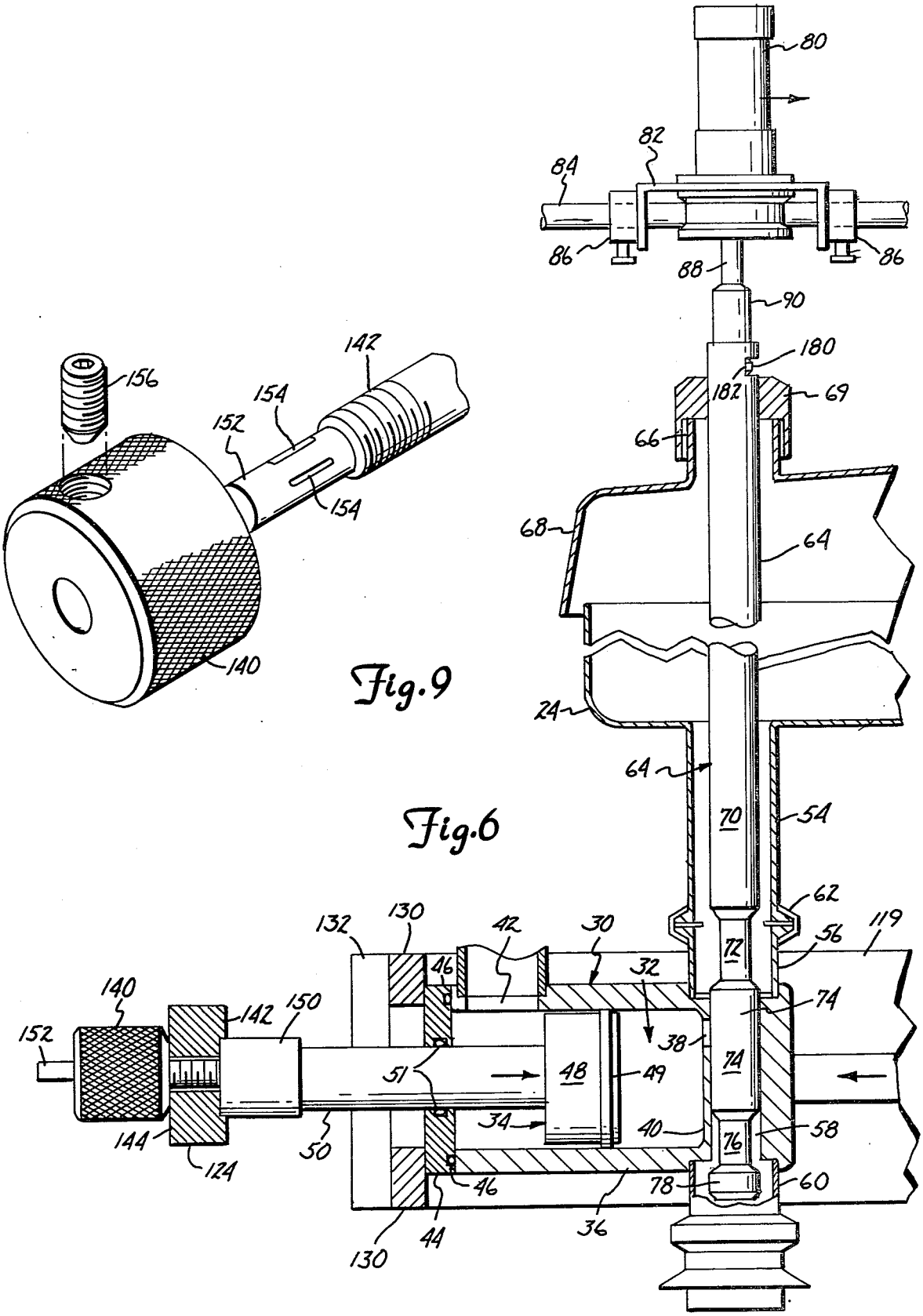
FIG. 9 is an exploded perspective view showing the adjusting apparatus for adjusting displacement of the pumping chamber.

The filling apparatus 22 of the present invention is shown in further detail in FIGS. 3–10. As best shown in FIGS. 5 and 6, each dispenser 28A–28CD includes a horizontally oriented pumping chamber 32 formed by cylinder 30 and piston 34. Cylinder 30 is formed in cylinder block 36 and has an inlet port 38, an outlet port 40, and a backside cleaning port 42. End plate 44 and O-ring 46 seal the rear end of cylinder 30. Piston 34 includes piston head 48, piston O-ring 49, and piston rod 50. As best illustrated in FIGS. 5 and 6, piston rod 50 slidably extends through rear plate 44. There is a seal 51 in plate 44 that creates a seal around rod 50.

A vertical liquid passage is provided from tank 24 to outlet head 52 of each dispenser 28A–28D. This vertical liquid passage includes downwardly extending pipe 54 (which is integral with the bottom portion of tank 24), vertical bore 58 through the front end of cylinder block 36, and pipe 60. The lower end of pipe 54 is connected to the upper end of pipe 56. Gasket 62 seals this connection. Pipe 56 is attached at its lower end to cylinder block 36, and communicates with vertical bore 58. Vertical bore 58 communicates with pump chamber 32 through inlet and outlet ports 38 and 40. Lower pipe 60 is attached to cylinder block 36 and communicates with the lower end of vertical bore 58. Outlet head 52 is mounted on a lower flange of pipe 60, with gasket 62 sealing this connection.

Extending through the vertical passage is valve stem or rod 64. Valve stem 64, which is preferably a rigid, high temperature plastic material such as polysulfone, extends downward through passage 66 in top cover 68 of tank 24, through tank 24 and downward coaxially through the previously described vertical liquid passage. Drip shield 69 covers passage 66 in top cover 68 so that no contamination can enter tank 24 through passage 66.

Valve stem 64 has an upper portion 70 which is narrower than the inner diameter of pipes 54 and 56; a neck portion 72 of a reduced diameter (which is smaller than the inner diameter of bore 58); a land portion 74 having an outer diameter which is essentially equal to the inner diameter of bore 58; a neck portion 76 of reduced diameter which is preferably equal to the diameter of portion 72; and a lowermost land portion 78 of a diameter equal to diameters of upper portion 70 and land portion 74.

Valve stem 64 is movable along its vertical axis by pneumatic actuator 80. Each bank of four pneumatic actuators 80 is mounted on inverted U-shaped channel member 82 which extends between a pair of parallel guide rods 84. Channel member 82, therefore, acts as a carriage for positioning of actuators 80. As will be described in further detail later, this is particularly useful in rapid disassembly and cleaning of the fill apparatus. Clamps 86 are attached to channel member 82 for clamping channel member 82 in place on rods 84. The actuating plunger 88 of pneumatic actuator 80 is connected to a quick connect/disconnect male coupling member 90, which in turn is connected to female coupling member 91 attached to the upper end of valve stem 64.

FIGS. 5 and 6 illustrate the two valve positions of valve stem 64. In FIG. 5, piston 34 is on a back stroke, thus drawing liquid from tank 24 downward through pipes 54 and 56, bore 58 and inlet port 38 into cylinder 30. Valve stem 64 is in its lowermost position which brings neck portion 72 into at least partial alignment with inlet port 38. As a result, liquid is permitted to flow from tank 24 down the vertical passage into cylinder 30.

At the same time, land portion 74 of valve stem 64 blocks outlet port 40 of cylinder 30 and lower land portion 78 of valve stem 64 is in engagement with valve seat 92 of outlet head 52. As a result, no fluid flow from cylinder 30 downward through screens 94 and dispensing opening of 96 outlet head 52 is permitted.

In FIG. 6, the direction of movement of piston 34 has been reversed, and piston 34 is on a forward pumping stroke. The position of valve stem 64 has also changed to its uppermost position. In this position, land portion 74 of valve stem 64 blocks inlet port 38 to cylinder 30. At the same time, neck portion 76 is brought into alignment with outlet port 40 of cylinder 30, so that liquid is forced by the forward movement of piston 34 out through outlet port 40. The raised position of stem 64 has also brought the lowermost land portion 78 of valve stem 64 out of engagement with valve seat 62. As a result, the liquid being pumped from cylinder 30 is permitted to pass through valve seat 62, through foam prevention screens 94 and out through dispenser opening 96 of outlet head 52.

In effect, therefore, neck portions 72 and 76 and land portion 74 act as a spool valve which is an integral part of valve stem 64 and controls flow into and out of cylinder 30. In addition, lowermost land portion 78 acts as a further integral valve which acts with valve seat 92 to control flow out of outlet head 52.

Figure 7:
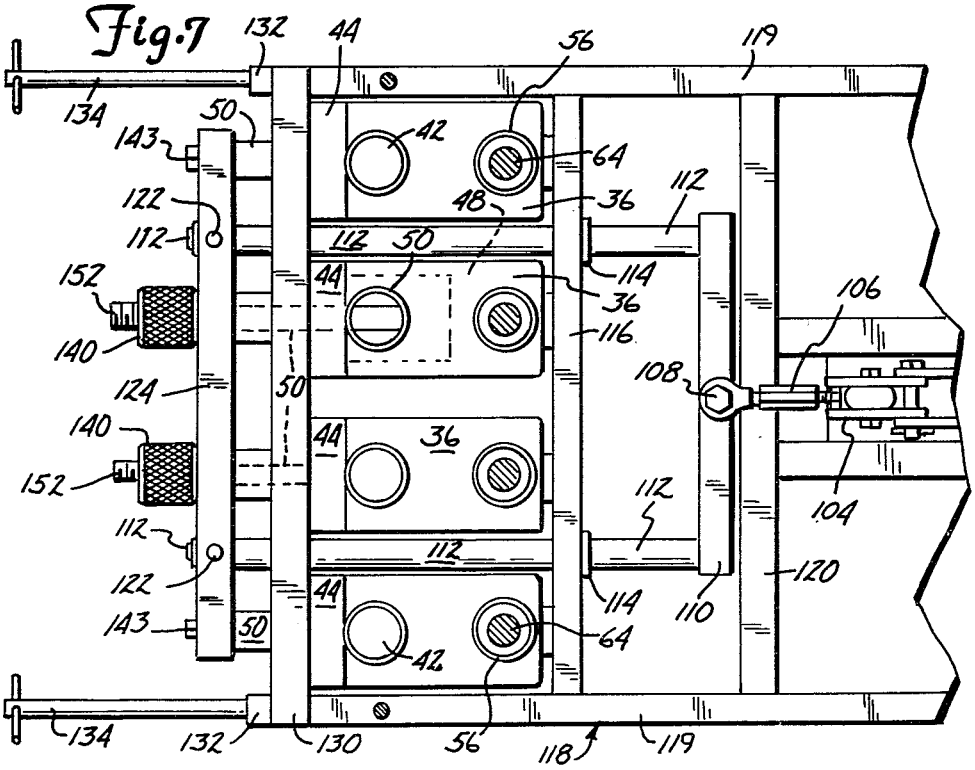
FIG. 7 is a sectional view along the line 7—7 of FIG. 4.

As best shown in FIGS. 4 and 7, the drive for all eight pistons 34 of machine 10 is provided by a single hydraulic actuator 100. Actuator 100 is connected through linkage 102 to a pair of pivotable bell cranks 104. Each bell crank 104 is connected through adjustable links 106 and arm or post 108 to movable cross member 110. Attached to cross member 110 are a pair of horizontal rods 112 which extend through sleeves 114 in cross brace 116 of frame 118. As illustrated in FIG. 7, frame 118 includes a pair of horizontal outlet frame members 119 which are generally parallel to rods 112 and cross brace 120 which extends between outer frame members 119. The outer ends of rods 112 are connected by quick disconnect fastener pins 122 to cross head 124. The outer ends of piston rods 50 are connected to cross head 124 in such a manner (described in further detail later) that as cross head 124 moves in and out due to motion of rods 112, pistons 34 are moved back and forth in cylinders 30.

End plate 44 is held in place by a pair of horizontal retainer bars 130 which extend across the width of frame 118 between the ends of outer frame members 119. A pair of vertical retainer bars are located at each end of horizontal bars 130. Retainer handles 134 have threaded ends which extend through slots in vertical retainer bars 132 and are threaded into threaded holes in the ends of frame 118. When retainer handles 134 are fully tightened down, pressure is applied through vertical retainer bars 132 and horizontal retainer bars 130 to hold end plates 44 in place.

In the embodiment shown in the Figures, two of the four pistons 34 of each bank 26 of dispensers 28A–28D have an adjustable stroke, and thus individually adjustable displacement. This allows precise adjustment of the liquid supplied to the carton to ensure that the proper quantity of liquid is dispensed into the cartons. In the particular embodiment shown dispensers 28B and 28C have individually adjustable displacement while dispensers 28A and 28D do not. With the apparatus illustrated in the Figures, an initial adjustment of the volumes pumped by all eight pumping chambers can be made by adjusting the effective stroke of hydraulic actuator 100. This initial adjustment is selected to slightly overfill the carton. The fine adjustment is then provided by individual adjustment of two of each bank of four pumping chambers 32 through fine adjustment handwheel 140. This reduces the total volume of liquid being delivered from the initial volume setting, so that the desired volume is supplied to each carton.

The two pistons of each bank of four which are not individually adjustable have piston rods 50 with threaded outer ends which are attached in a fixed manner to cross head 124 by threaded nuts 143. The two individually adjustable pistons, on the other hand, have a threaded end 142 which extends through hole 144 in cross head 124, as shown in FIGS. 5, 6 and 8. Handwheel 140 has internal threads which engage the external threads on threaded portion 142 of piston rod 50, as best shown in FIGS. 8 and 9. Compression spring 146 is mounted coaxially on threaded portion 142 of piston rod 150 between shoulder 148 of piston rod 50 and cross head 124. Spring 146 is covered by sleeve 150. As handwheel 140 is rotated in a first direction on threaded portion 142, it compresses spring 146 by reducing the distance between shoulder 148 and cross head 124. On the other hand, if wheel 140 is rotated in the opposite direction, it causes shoulder 148 to be moved away from cross head 124 due to the force of spring 146.

The amount of compression of spring 146 determines the displacement of piston 134. The force of spring 146 is sufficient to permit pumping of liquid from cylinder 30, but this spring force is overcome when piston head 48 reaches the end of cylinder 30. Thus by varying the amount of compression of spring 146 by handwheel 140, the effective starting position of piston head 48 when it is in its fully retracted position is varied. The less spring 146 is compressed, the further forward piston head 48 will be as it starts its forward stroke, and the smaller the volume of fluid displaced as piston 48 is driven forward.

In the preferred embodiments of the present invention, as illustrated in FIGS. 8 and 9, the outermost portion 152 of piston rod 50 has a smaller diameter than threaded portion 142, and has a plurality of detent slots 154 positioned around its periphery. Mounted in handwheel 140 is ball plunger 156, which engages detent slots 154. This provides a positive indication to the operator of each incremental movement of handwheel 140, thus assisting the operator in making fine volume displacement adjustments by means of handwheel 140.

One important advantage of the apparatus of the present invention is its ability to be cleaned in place thoroughly and efficiently. Because the valve mechanism of the present invention is simple, and involves only vertical movement of valve stem 64, the use of O-rings or complicated spring loaded check valves is minimized or eliminated. The possibility of bacteria build-up is significantly reduced, because the vertical passage provided in the present invention minimizes the fluid passage length. Cleaning in place is achieved by filling tank 24 with cleaning solution and cycling the filling apparatus so that pistons 34 move back and forth. Valve stem 64 can also be moved up and down during this cleaning operation to ensure that all portions of the vertical passage are cleaned. In addition, the horizontal orientation of cylinders 30 allows a clean in place (CIP) manifold 160 to be permanently mounted above cylinder blocks 36. CIP manifold 160 is connected to cleaning ports 42 on the backside of each piston, and permits cleaning fluid to be supplied to the backside of each piston head 48. Thus both sides of O-ring 49 can be cleaned in place quickly and efficiently. Cleaning fluid can be drained from the back side of piston heads 48 quickly and easily by releasing retainer handles 134 slightly.

Another important feature of the present invention is its ability to be quickly and easily disassembled, hand-cleaned, and then reassembled. By releasing connectors 122 to disconnect cross head 124 from rods 112, and releasing retainer handles 134, all four pistons 34 can be withdrawn from their respective cylinders 30. The individual piston heads 48 are held in place on the ends of piston rods 50 by a simple slot and head arrangement. As shown in FIG. 5, each piston head 48 has a T-shaped slot which receives a T-shaped head 171 at the end of piston rod 50. The single elastomeric O-ring 49 can be easily removed from piston head 48 for hand-cleaning.

The disassembly of the valve mechanism is also easily accomplished. First, each drip shield 69, which normally is in the position shown in FIG. 5, is pulled downward to the position shown in FIG. 6. This exposes the connection between male coupling member 90 which is attached to actuating plunger 88 of actuator 80 and female coupling member 91 which is attached to the upper end of valve stem 64. As shown in FIGS. 5, 6 and 10, female coupling member 91 has a T-shaped slot 180 which receives and holds T-shaped head 182 of male coupling member 90. Members 90 and 91 can be connected and disconnected from one another by relative movement in a horizontal direction. This movement is achieved by deactuating pneumatic actuator 80 and loosening clamps 86 to permit horizontal movement of carriage 82 on horizontal rods 84, as illustrated by the arrow in FIG. 6 eminating from actuator 80 and as illustrated by the phantom position of actuator 80 and carriage 82 illustrated in FIG. 4.

Once actuators 80 have been disconnected from valve stems 64, it is possible to remove valve stems 64 simply by lifting them out of the vertical passage through which they extend. Valve stems 64 may then be handwashed and reinserted into the vertica passages. Reconnection of actuators 80 with valve stems 64 is achieved by sliding carriage 82 back into position, making the connection between coupling members 90 and 91, and moving drip shield 69 back to its normal position as illustrated in FIG. 5.

A normal operating sequence of the fill apparatus of the present invention begins with the indexing of cartons 200 (shown in FIG. 4) to a position under each of the outlet heads 52. (As shown in FIG. 4, a shield 202 is also preferably mounted on outlet head 52 to prevent contamination during filling of cartons 200.)

Once the indexing movement of conveyor 20 has stopped, pneumatic actuators 80 lift valve stems 64 and hydraulic cylinder 100 causes pistons 34 to be driven forward, thus pumping the liquid contained in chamber 32 out through outlet 52 into cartons 200. When pistons 34 reach the forwardmost position of their stroke, hydraulic actuator 80 drives valve stem 64 downward to its lowermost position, which blocks outlet port 40 and outlet head 52 and permits liquid to be drawn from fill tank 24 into cylinder 30. Hydraulic actuator 100 causes pistons 34 to be driven rearwardly, in anticipation for the next cycle. When the next carton has been indexed into position, the operation of valve stem 64 and pistons 34 is repeated.

In a preferred embodiment of the present invention, a pneumatic limit valve (not shown) is provided to sense whether a carton 200 is in position below outlet 52. If no carton is present, pneumatic actuator 80 is not actuated when piston 34 begins to move forward, and piston 34 merely forces liquid contained in cylinder 32 back into fill tank 24. As a result, milk or other liquid will not be dispensed from a particular dispenser 28A–28D if no carton is present below that dispenser.

Other advantageous embodiments of the present invention are also possible. For example, although pumping chambers 30 shown in the Figures include pistons and cylinders, the present invention is equally applicable to a system in which pumping chambers 30 are in the form of bellows. The use of bellows as pumping chambers 30 further simplifies the construction of the fill apparatus and can, in some cases, significantly reduce the cost and complexity of the apparatus and further simplify cleaning.

Similarly, although valve stem 64 is shown in an embodiment where filling of the pumping chamber occurs when valve stem 64 is in its lower position and dispensing of liquid into the carton occurs when valve stem 64 is in its upper position, other configurations of the various portions of valve stem 64 are possible. For example with a different arrangement of land and neck portions, filling can occur with a different arrangement of land and neck portions, it iswhen valve stem 64 is in its upper position and dispensing of liquid when valve stem 64 is in its lower position. In one such embodiment, the lower end of valve stem 64 engages and positively opens an outlet check valve when valve stem 64 is in its lowermost position. When valve stem 64 is moved to its upper position, the spring bias of the check valve causes the check valve to be closed. The advantage of this positive mechanical opening of the outlet check valve is that it does not rely upon the pressure of the liquid to open the check valve. As a result, the creating of foam due to the velocity of liquid passing by the outlet check valve as it is opened by the liquid pressure is minimized. The advantage of using the valve stem of the present invention in conjunction with an outlet check valve is that the fill apparatus can again be simple in configuration, more readily cleanable, and have a minimum amount of parts to be cleaned.

Although the present invention has been described with reference to preferred embodiments, workers skilled in the art will recognize that changes may be made in form and detail without departing from the spirit and scope of the invention.

What is claimed is:

1. A container filling apparatus for filling an open top container with a predetermined quantity of a liquid food product, the container filling apparatus comprising:

a fill tank for holding the liquid;

a vertical passage having an inlet at an upper end communicating with the fill tank and having an outlet at a lower end from which the liquid is dispensed into the container;

a pumping chamber connected to the vertical passage by an inlet port and an outlet port for drawing liquid from the fill tank through the vertical passage and the inlet port into the pumping chamber and for pumping the liquid from the pumping chamber through the outlet port and the vertical passage to the outlet;

a vertically oriented, linearly movable valve member extending along a vertical axis downward through the fill tank and the vertical passage, the valve member having a portion which permits liquid flow from the fill tank through the vertical passage and to the inlet port to the pumping chamber when the valve member is in a first position along the vertical axis and which blocks liquid flow from the fill tank through the vertical passage and to the inlet port to the pumping chamber when the valve member is in a second position along the vertical axis, and the valve member having a portion which blocks liquid flow from the pumping chamber through the outlet port and the vertical passage to the outlet when the valve member is in the first position and which permits liquid flow from the pumping chamber through the outlet port and the vertical passage to the outlet when the valve member is in the second position;

drive means for driving the pumping chamber to cause the pumping chamber to draw liquid into the pumping chamber through the inlet port and to pump liquid from the pumping chamber through the outlet port to the outlet; and valve actuator means for moving the valve member along the vertical axis, the valve actutor means being coordinated with the drive means to cause the valve member to be in its first position when the drive means causes the pumping chamber means to draw liquid into the pumping chamber means and to cause the valve member to be in its second position when the drive means causes the pumping chamber means to pump liquid from the pumping chamber means to the outlet.

2. The apparatus of claim 1 wherein the pumping chamber is connected to and extends in a horizontal direction essentially perpendicular to the vertical passage.

3. The apparatus of claim 2 wherein the pumping chamber includes a cylinder and a piston movable in the cylinder, and wherein the drive means drives the piston to move in the cylinder.

4. The apparatus of claim 3 wherein the cylinder is an essentially horizontal cylinder formed in a cylinder block, and wherein the vertical passage includes a vertical bore through the cylinder block adjacent to a first end of the cylinder, and wherein the inlet port and the outlet port connect the cylinder and the vertical bore.

5. The apparatus of claim 4 wherein the vertical passage further includes a first vertical conduit connected between the inlet and an upper end of the vertical bore.

6. The apparatus of claim 5 wherein the vertical passage further includes a second vertical conduit connected between a lower end of the vertical bore and the outlet.

7. The apparatus of claim 4 wherein the valve member opens the inlet port and blocks the outlet port when it is in its first position, and opens the outlet port and blocks the inlet port when it is in its second position.

8. The apparatus of claim 4 wherein the cylinder block also includes a cleaning port adjacent a second end of the cylinder.

9. The apparatus of claim 8 and further comprising:

a cleaning manifold permanently affixed to the cleaning port through which cleaning liquid is supplied to the cylinder.

10. The apparatus of claim 9 wherein the piston includes a piston head movable in the cylinder and a piston rod connected to the piston head and to the drive means.

11. The apparatus of claim 10 and further comprising:

a plate for sealing the second end of the cylinder, wherein the piston rod extends out through the plate to make connection with the drive means; and retainer means for releasably applying a force to the plate to maintain the plate in a position which seals the second end of the cylinder.

12. The apparatus of claim 3 wherein the piston includes a piston head movable in the cylinder and a piston rod connected between the piston head and the drive means; and further comprising:

compressible spring means connected between the piston rod and the drive means; and adjusting means for adjusting compression of the spring means to adjust displacement of the piston.

13. The apparatus of claim 12 wherein the piston rod has a shoulder and wherein the compressible spring means is a compression spring mounted coaxially on the piston rod and having one end abutting the shoulder of the piston rod and an opposite end abutting the drive means; and wherein the adjusting means adjusts spacing between the shoulder and the drive means when the compression spring is fully extended.

14. The apparatus of claim 13 wherein the adjusting means includes a threaded outer end portion of the piston rod and a rotatable adjusting wheel having internal threads for engaging the threaded portion of the piston rod, the adjusting handwheel bearing against the drive means so that the position of the adjusting wheel on the threaded portion of the piston rod controls spacing between the shoulder and the drive means, when the compression spring is fully extended.

15. The apparatus of claim 1 wherein the valve member has a first land portion which opens the inlet port and blocks the outlet port when the valve member is in its first position, and which opens the outlet port and blocks the inlet port when the valve member is in its second position.

16. The apparatus of claim 15 wherein the valve member has a portion below the first land portion which causes the outlet to be blocked when the valve member is in its first position and which causes the outlet to be open when the valve member is in its second position.

17. The apparatus of claim 16 and further comprising a valve seat at the outlet, and wherein the portion of the valve member below the first land portion is a second land portion which engages the valve seat when the valve member is in its first position to block the outlet, and is out of engagement with the valve seat to permit liquid flow to the outlet when the valve member is in its second position.

18. The apparatus of claim 17 wherein the first position is below the second position.

19. The apparatus of claim 1 wherein the valve member extends above the fill tank, and wherein the valve actautor means is positioned above the fill tank and is connected to an upper end of the valve member.

20. The apparatus of claim 19 wherein the fill tank has a top cover, and wherein the top cover has an opening coaxially aligned with the vertical passage through which the valve member extends.

21. The apparatus of claim 20 and further comprising a drip shield mounted on the valve member for covering the opening in the top cover of the fill tank.

22. The apparatus of claim 20 and further comprising:

a horizontal track positioned above the fill tank;

a carriage movable in a horizontal direction on the horizontal track, the valve actuator means being mounted on the carriage; and releasable connection means for connecting the valve actuator means and an upper end of the valve member.

23. The apparatus of claim 22 wherein the carriage is positioned above the upper end of the valve member when the releasable connection means connects the valve member and the valve actuator means; and wherein the carriage is movable on the horizontal track, when the releasable connection means is not connecting the valve member and the valve actuator means, to a position which permits withdrawal of the valve member in a vertical direction upward from the vertical passage through the opening in the top cover.

* * * * *